US005779149A

United States Patent [19]

Hayes, Jr.

[11] Patent Number: 5,779,149

[45] Date of Patent: Jul. 14, 1998

[54] PIEZOELECTRIC CONTROLLED COMMON RAIL INJECTOR WITH HYDRAULIC AMPLIFICATION OF PIEZOELECTRIC STROKE

[75] Inventor: Edward James Hayes, Jr., Virginia Beach, Va.

[73] Assignee: Siemens Automotive Corporation, Auburn Hills, Mich.

[21] Appl. No.: 674,556

[22] Filed: Jul. 2, 1996

[51] Int. Cl.[6] ..... F02M 51/00; B05B 9/00

[52] U.S. Cl. ..... 239/124; 239/533.9

[58] Field of Search ..... 239/88, 96, 102.1, 239/102.2, 124, 127, 533.8, 533.9, 585.1, 584

[56] References Cited

U.S. PATENT DOCUMENTS 5,143,291 9/1992 Grinsteiner ..... 239/88

5,472,142 12/1995 Iwanaga ..... 239/533.8 X 5,542,610 8/1996 Augustin ..... 239/533.8

*Primary Examiner*—Lesley D. Morris

*Attorney, Agent, or Firm*—Russel C. Wells

[57] ABSTRACT

A common rail fuel injector utilizes a piezoelectric actuator (8) to open and close the injector valve (3). Intermediate the piezoelectric actuator and the injector valve are a large diameter first piston (9) in fluid communication with a smaller diameter second piston to multiply the actuation extension of the piezoelectric actuator. The second piston (11) operates a poppet valve (1) to hydraulically control the injector valve.

19 Claims, 4 Drawing Sheets

PIEZOELECTRIC CONTROLLED COMMON RAIL INJECTOR WITH HYDRAULIC AMPLIFICATION OF PIEZOELECTRIC STROKE

BACKGROUND OF THE INVENTION

This invention is related to means of controlling a common rail injector with an electrical device, especially a piezoelectric actuator.

Most common rail injectors utilize a control chamber to control nozzle opening and closing. An actuator opens a drain valve to relieve the control chamber pressure and open the nozzle, closing the drain valve allows the control pressure to increase again and close the nozzle. For solenoid systems, control of the drain valve is straightforward, because solenoids can be designed to lift the drain valve with the appropriate stroke and force. With piezoelectric actuators, control of the drain valve tends to be more complicated because the piezoelectric stroke typically needs to be amplified and the direction of motion typically needs to be reversed to have a normally closed valve.

DE 44 34 892 A1 shows a fuel injector for an internal combustion engine with a control valve housed in a body, with an electrical device for operating the control valve which regulates the pressure in a control chamber which acts on a power piston, which is mechanically connected to a nozzle needle for opening and closing the corresponding nozzle.

SUMMARY OF THE INVENTION

The present invention uses a simple hydraulic amplifier to increase the stroke of the piezoelectric actuator and compensate for tolerances and shifts due to temperature and wear. The piezoelectric actuator acts directly on a hydraulic piston, causing a pressure rise in the hydraulic chamber below it. This pressure acts on a second piston, which normally would have a smaller area to amplify the stroke of the piezoelectric actuator and first piston. This second piston pushes against the normally closed drain valve, which is located in the control chamber, to open it. When the piezoelectric actuator is deenergized, the hydraulic chamber pressure drops and the drain valve is closed by the control chamber pressure and the spring below the drain valve.

A check valve, or a flow restrictor, supplies fuel to the hydraulic chamber, from the nozzle drain, keeping the chamber filled and thereby compensating for tolerances, setup differences and temperature shifts.

This description is based on a 2/2 drain valve. This same hydraulic amplifier concept is also shown with a 3/2 valve having a ball as a valve element.

According to a prefered embodiment of the invention there is provided a piezo actuated fuel injector comprising an hydraulic amplifier to increase the stroke of the piezo stack and a 2/2 poppet valve with the return spring on the top side of the valve. This valve structure gets the return spring out of the control chamber while maintaining referencing of the amplifier secondary piston in contact with the drain valve, since the upward force stops when the valve is closed.

DETAIL DESCRIPTION

Figure 1:
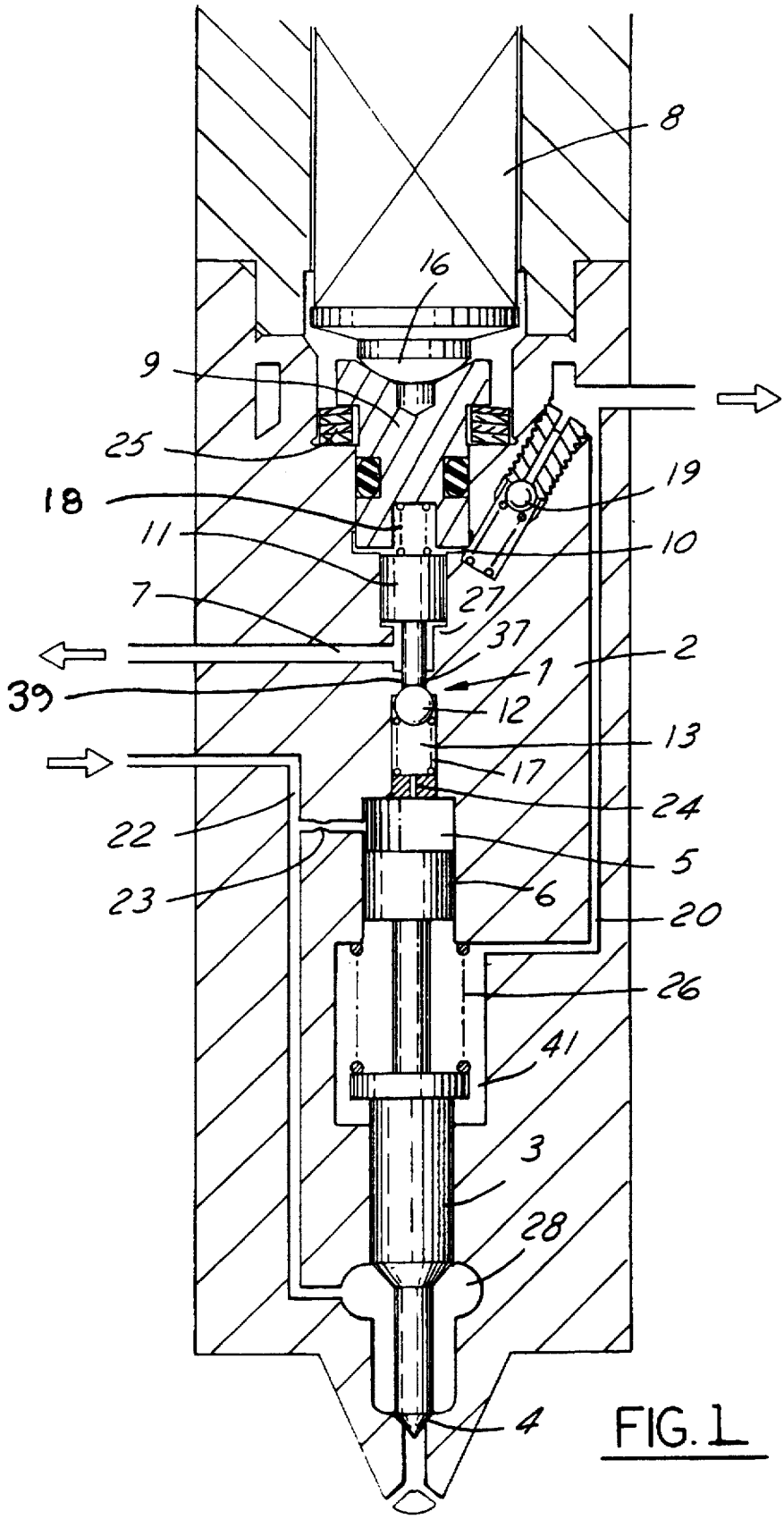
FIG. 1 is an assembly drawing of the injector with hydraulic amplifier and a 2/2 type control valve, FIG. 2 details the hydraulic amplifier with a 3/2 type control valve, FIG. 3 details the hydraulic amplifier with a poppet valve.

In accordance with an advantageous embodiment, the injector, as per invention, comprises (see FIG. 1): a body 2 which houses, in its upper part, a piezoelectric actuator 8, an hydraulic stroke amplifier comprising two pistons, 9 and 11, which coaxially face onto an hydraulic chamber 10 that is filled with fuel at a low pressure, and a control valve 1 to control the pressure of the fuel contained in a control chamber 5 onto which a power piston 6 faces. The power piston being mechanically connected to an injection valve needle fitted to an end of the above mentioned body 2.

The actuator 8, which extends in proportion to the level of electrical voltage applied to the same, operates on the first piston 9 of the two fluid-tight pistons which face onto the hydraulic chamber 10. An adapter plate 16 fitted with a spherical seat is inserted to facilitate this. Elastic means or a group of cup-shaped springs 25, which exert an upward force on the aforementioned first piston 9, ensure that contact is constantly made between the first piston 9, the adapter plate 16 and the actuator 8. The second piston 11 faces onto the above mentioned hydraulic chamber 10 with an effective surface area smaller than that of the first piston 9. The second piston 11 is provided with a small diametered appendix 37 at the end opposite the hydraulic chamber 10. The appendix 37, passing through the control valve 1 drain hole 39 and pushed forward by the pressure contained in the hydraulic chamber 10 and by the spring 18 placed between the two pistons 9, 11, rests against the control valve's sealing component 12. The spring 18 is optional. In order to push on the sealing component 12 and enable the discharge of the fuel contained in the control chamber 5, the appendix 37 of the second piston 11 presents an external diameter smaller than that of the control valve drain hole.

A first return spring 17, which is arranged in a valve chamber 13, and the pressure of the fuel contained in the valve chamber 13 operates on the surface of the control valve's sealing component 12 opposite the second piston 11. When the control valve 1 is closed, this pressure is equal to that of the fuel contained in the control chamber 5.

A feeding line 22, which feeds the fuel at high pressure, connects a common rail (not shown) to the injection valve pressure chamber 28. In the 2/2 type control valve version (FIG. 1), the control chamber 5 is constantly connected to the feeding line 22 by means of a flow restrictor 23.

As already stated, the power piston 6, which is mechanically connected to the coaxial injection valve's needle 3, faces onto the control chamber 5. Moreover, a second return spring 26, which is housed in a piston chamber 41, operates to close the aforementioned valve needle 3.

The drain line 7 returns back to the tank the fuel discharged from the control chamber during the injection stroke. The recovery line 20 recovers the fuel leaked through the slight diametrical clearance which exists between the nozzle needle 3 and the injection valve body. A small refill valve 19 faces onto the recovery line 20 which is maintained at a slight over-pressure. The refill valve 19 enables fuel to be fed back into the hydraulic chamber 10 in order to compensate the fuel leaked, during the compression stroke activated by the actuator 8, through the clearance existing between the two pistons 9 and 11 and the injector body 2.

Figure 2:
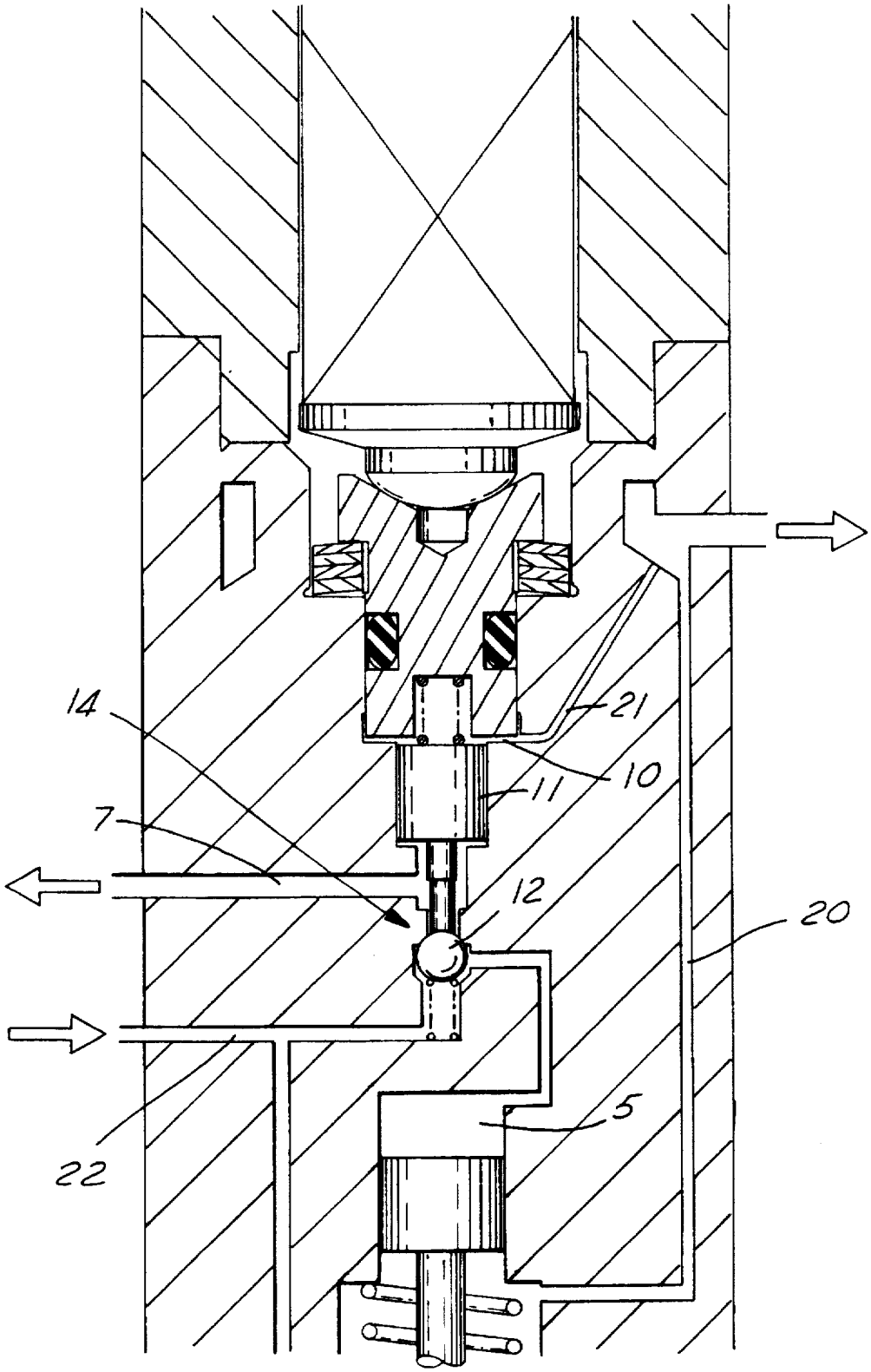

In another embodiment, the aforementioned refill valve 19 may be economically replaced by a feeding duct 21. Also the duct 21 connects the hydraulic chamber 10 with the recovery line 20 and flows into the reduced diametrical clearance which exists between one of the two pistons 9 or 11 and the body 2 of the aforementioned injector. The feeding duct 21 is shown in FIG. 2.

OPERATIONAL DESCRIPTION

When the piezo actuator 8 is electrically de-energized, the control valve sealing component 12 comes into contact with the valve conical seat, thereby interrupting the connection between the control chamber 5 and the drain line 7.

Since the control chamber 5 is constantly connected, by means of a flow restrictor 23, to a feeding line 22 that carries the fuel at high pressure from the common rail to the injection valve, it follows that the control chamber 5 assumes the same level of pressure contained in the feeding line 22.

The pressure in the control chamber 5 operates the power piston 6 that is mechanically connected to the injection valve needle 3 and, together with the load of a return spring 26, keeps the needle 3 compressed against its seat 4.

Therefore, in the situation described above no fuel injection takes place.

When the actuator 8 is electrically energized, it activates an extension proportional to the level of electrical voltage applied to the same, thereby determining an analogous movement of the first piston 9 which is held in contact with the actuator 8 by a group of cup-shaped springs 25.

The movement of the first piston 9 causes, in turn, an increase in the fuel pressure contained in the hydraulic chamber 10, onto which the second piston 11 also faces. The second piston has an effective surface area smaller than that of the coaxial first piston 9. The second piston 11 is held constantly in contact with the control valve sealing component 12 by the pressure contained in the hydraulic chamber 10. Therefore, when the push determined by such pressure exceeds the force acting on the sealing component 12 of the control valve 1, which is caused by the fuel pressure contained in the valve chamber 13 hydraulically connected to the control chamber 5 and the force from the first return spring 17, the second piston 11 moves axially towards the valve chamber 13, thereby forcing the control valve 1 to open and so connecting the control chamber 5 to the first drain line 7. Force is transmitted from the second piston 11 to the valve sealing component 12 by means of the appendix 37 on the second piston 11, which protrudes through the drain valve hole.

Because of the difference between the effective surface areas of the two pistons, the stroke of the second piston 11, and therefore also the stroke of the sealing component 12, will be longer than that of the first piston 9.

Owing to the fact that the drain line 7 is now connected to the control chamber 5 and a flow restrictor 23 is provided in the connection duct between the control chamber 5 and the feeding line 22, the pressure in the control chamber 5 will undergo a considerable reduction.

The subsequent reduction in the force acting on the power piston 6 enables the high fuel pressure operating on the injection valve needle's lower surface 3 to exceed the push that keeps the needle closed. Consequently, the needle 3 retracts from its sealing seat 4 and thus the injection phase begins.

The quantity of fuel injected into the cylinder of the associated internal combustion engine will depend, not only on the fuel pressure, but also on the duration and modulation of the electrical signal provided to the actuator 8.

When the electric signal ends, the piezoelectric actuator 8 will return to its original length, causing the corresponding withdrawal of the first piston 9 and a reduction in the pressure contained in the hydraulic chamber 10. As a result, the force of the residual pressure acting on the sealing component 12, and the first return spring 17, will cause the second piston 11 to return to its original position and the sealing component to shut off the hydraulic connection between the control chamber 5 and the drain line 7.

Following this, the pressure in the control chamber 5 will return to the same level as that of the fuel contained in the feeding line 22, and the increased pressure on the power piston 6 will cause the nozzle needle 3 to close. Subsequently, a stop of the injection phase will occur.

During the non-injection period, the small refill valve 19 will enable the liquid that leaked through the diametrical clearance between the two pistons 9 and 11 and the injector body 2, during the compression stroke activated by the actuator 8, to be restored to the hydraulic chamber 10. For this purpose, the small refill valve 19 will connect the hydraulic chamber 10 to the recovery line 20 of the fuel leaked through the peripheral clearance of the injection valve needle 3. A pressure valve, normally located externally to the injector, enables the recovery line 20 to be maintained at a slight positive pressure level.

The action of restoring the quantity of fuel leaked from the hydraulic chamber 10 during the compression stroke activated by the actuator ensures that, at the beginning of each operating stroke, the hydraulic chamber 10 is always refilled with fuel and, therefore, the second piston's 11 appendix 37 is constantly in contact with the sealing component 12 of the control valve 1. This is an extremely important feature as it renders the injector free from problems of wear to or thermal expansion and it also makes easier the injector set-up during the production process.

Alternatively instead of the refill valve 19, fluid may also be refilled to the hydraulic chamber 10 by means of a refill duct 21 which is connected to the recovery line 20 and which flows into the small diametrical clearance existing between one of the two pistons 9 or 11 and the body 2 of the injector.

In order to ensure steady functional performance, the second piston 11 can be provided with a stroke limit stop 27, which is formed by shoulders in the body 2.

Finally, a flow restrictor 24 may be inserted into the section of the hydraulic drain circuit that is fitted between the control chamber 5 and the drain line 7, so as to adapt the course of the nozzle needle's 3 opening stroke and, therefore, the initial injection phase, to the needs of the diesel engine.

FIG. 2 shows an injector produced in accordance with the specifications of the invention, but fitted with a 3/2 type control valve 14. Instead of the refill valve 19 a refill duct 21 is shown, but it is possible to use instead a refill valve 19.

In this case, the control valve sealing component 12 determines the alternative connection of the control chamber 5 to the feeding line 22 or to the drain line 7. This solution enables the problem of considerable quantities of pressurized fuel lost through the drain line 7 during the injection phase to be avoided.

The use of a spherical sealing component 12 and of a piezoelectric actuator fitted with an hydraulic stroke amplifier allows for injectors with extremely good operational features to be produced more economically.

Characteristically, the injection valve needle 3 of an injector produced to these specifications moves into a closed position when the actuator 8 is electrically de-energized. This is very important for safety reasons.

In accordance with an advantageous embodiment, the injector, as per invention, comprises (see FIG. 3): a poppet type control valve 1 to control the pressure of the fuel contained in a control chamber 5 onto which a power piston 6 faces. The power piston is mechanically connected to the needle of an injection valve fitted to an end of the above mentioned body 2. The second piston 11, pushed forward by the pressure contained in the hydraulic chamber 10 and by the spring 18 placed between the two pistons 9, 11, rests against the poppet type control valve 1.

The control valve 1 comprises a body 36 with a sealing seat in the lower side and a poppet needle 30 axially guided in the body 36 and provided of a mushroom shaped head 33 cooperating with the body seat. A second return spring 31, housed in a spring chamber 15 below the second piston 11, is mechanically connected to the top side of the poppet needle stem, e.g. by means of a snap ring 38.

The control valve sealing seat faces onto a valve chamber 13 hydraulically connected to the injector control chamber 5. Downstream the valve seat, the valve body 36 is connected to drain line 7.

The second return spring 31 and the pressure of the fuel contained in the valve chamber 13 exert an upwards force on the amplifier second piston 11. When the control valve 1 is closed, the pressure in the valve chamber 13 is equal to that of the fuel contained in the control chamber 5.

The drain line 7 returns back to the tank the fuel discharged from the control chamber 5 during the injection stroke. The recovery line 20 recovers the fuel leaked through the slight diametrical clearance which exists between the nozzle needle 3 and the injection valve body.

The control chamber 5 is connected over a flow restrictor 23 with the feeding line 22.

OPERATION

When the piezo actuator 8 is electrically de-energized, the control valve poppet needle 30 comes into contact with the valve body 36 conical seat, thereby interrupting the connection between the control chamber 5 and the drain line 7.

Since the control chamber 5 is constantly connected, by means of a flow restrictor 23, to the feeding line 22 that carries the fuel at high pressure from the common rail to the injection valve, it follows that the control chamber 5 assumes the same level of pressure contained in the feeding line 22.

The pressure in the control chamber operates the power piston 6 that is mechanically connected to the injection valve needle 3 and, together with the load of the second return spring 26, keeps the needle 3 compressed against its seat 4.

Therefore, in the situation described above no fuel injection takes place.

When the actuator 8 is electrically energized, it activates an extension proportional to the level of electrical voltage applied to the same, thereby determining an analogous movement of the first piston 9 which is held in contact with the actuator 8, by a group of cup-shaped springs 25.

The movement of the first piston 9 causes, in turn, an increase in the fuel pressure contained in the hydraulic chamber 10, onto which the second piston 11 also faces. The second piston 11 has an effective surface area smaller than that of the coaxial first piston 9. The second piston 11 is held constantly in contact with the control valve poppet needle 30 by the pressure contained in the hydraulic chamber 10. Therefore, when the push determined by such pressure exceeds the force acting on the valve poppet needle 30, which is caused by the fuel pressure contained in the valve chamber 13 hydraulically connected to the control chamber 5 and the force from the second return spring 31, the second piston 11 moves axially towards the control valve 1, thereby forcing the valve to open and so connecting the control chamber 5 to the drain line 7.

Because of the difference between the effective surface areas of the two pistons 9, 11, the stroke of the second piston 11, and therefore also the stroke of the poppet needle 30, will be longer than that of the first piston 9.

Owing to the fact that the drain line 7 is now connected to the control chamber 5 and a flow restrictor 23 is provided in the connection duct between the control chamber 5 and the feeding line 22, the pressure in the control chamber 5 will undergo a considerable reduction.

The subsequent reduction in the force acting on the power piston 6 enables the high fuel pressure operating on the injection valve needle's lower surface 3 to exceed the push that keeps the needle 3 closed. Consequently, the needle 3 retracts from its sealing seat 4 and thus the injection phase begins.

The quantity of fuel injected into the cylinder of the associated internal combustion engine will depend, not only on the fuel pressure, but also on the duration and modulation of the electrical signal provided to the actuator 8.

When the electric signal ends, the piezoelectric actuator 8 will return to its original length, causing the corresponding withdrawal of the first piston 9 and a reduction in the pressure contained in the hydraulic chamber 10. As a result, the force of the residual pressure acting on the poppet needle 30, and the second return spring 31, will cause the second piston 11 to return to its original position and the poppet needle 30 to shut off the hydraulic connection between the control chamber 5 and the drain line 7.

Following this, the pressure in the control chamber 5 will return to the same level as that of the fuel contained in the feeding line 22, and the increased pressure on the power piston 6 will cause the injection valve needle 3 to close. Subsequently, a stop of the injection phase will occur.

According to the spirit of the invention, the location of a strong second return spring 31 on the top side of the control valve 1, outside the control chamber 5 hydraulic circuit, assures a fast closing of the valve without increasing the total control chamber volume.

During the non-injection period, a small refill valve 19 will enable the liquid that leaked through the diametrical clearance between the two pistons 9 and 11 and the injector body 2, during the compression stroke activated by the actuator 8, to be restored to the hydraulic chamber 10. For this purpose, the small refill valve 19 will connect the hydraulic chamber 10 to the recovery line 20 of the fuel leaked through the peripheral clearance of the injection valve needle 3. A pressure valve (not shown), normally located externally to the injector, enables the recovery line 20 to be maintained at a slight positive pressure level.

The refilling of the hydraulic chamber 10, through the refill valve 19, during the non-injection period, is enabled by the fact that the return spring 31 force on the second piston stops when the poppet valve is closed. This prevents any further upwards movement of the piston in case of leakage during the compression stroke.

The action of restoring the quantity of fuel leaked from the hydraulic chamber 10 during the compression stroke activated by the actuator ensures that, at the beginning of each operating stroke, the hydraulic chamber 10 is always refilled with fuel and, therefore, the second piston 11 is constantly in contact with the stem of the control valve poppet needle 30. This is an extremely important feature as it renders the injector free from problems of wear or thermal expansion and it also makes easier the injector set-up during the production process.

Alternatively, fluid may also be refilled to the hydraulic chamber by means of a refill duct 21 which is connected to the recovery line 20 and which flows into the small diametrical clearance existing between one of the two pistons 9 or 11 and the body 2 of the injector.

In order to ensure steady functional performance, the second piston 11 or the poppet valve needle 30 can be provided with a stroke limit stop 27, 32.

Finally, a second flow restrictor 24 may be inserted into the section of the hydraulic drain circuit that is fitted between the control chamber 5 and the drain line 7, so as to adapt the course of the nozzle needle's 3 opening stroke and, therefore, the initial injection phase, to the needs of the diesel engine.

Characteristically, the injection valve needle 3 of an injector produced to these specifications moves into a closed position when the actuator 8 is electrically de-energized. This is very important for safety reasons.

Figure 3:
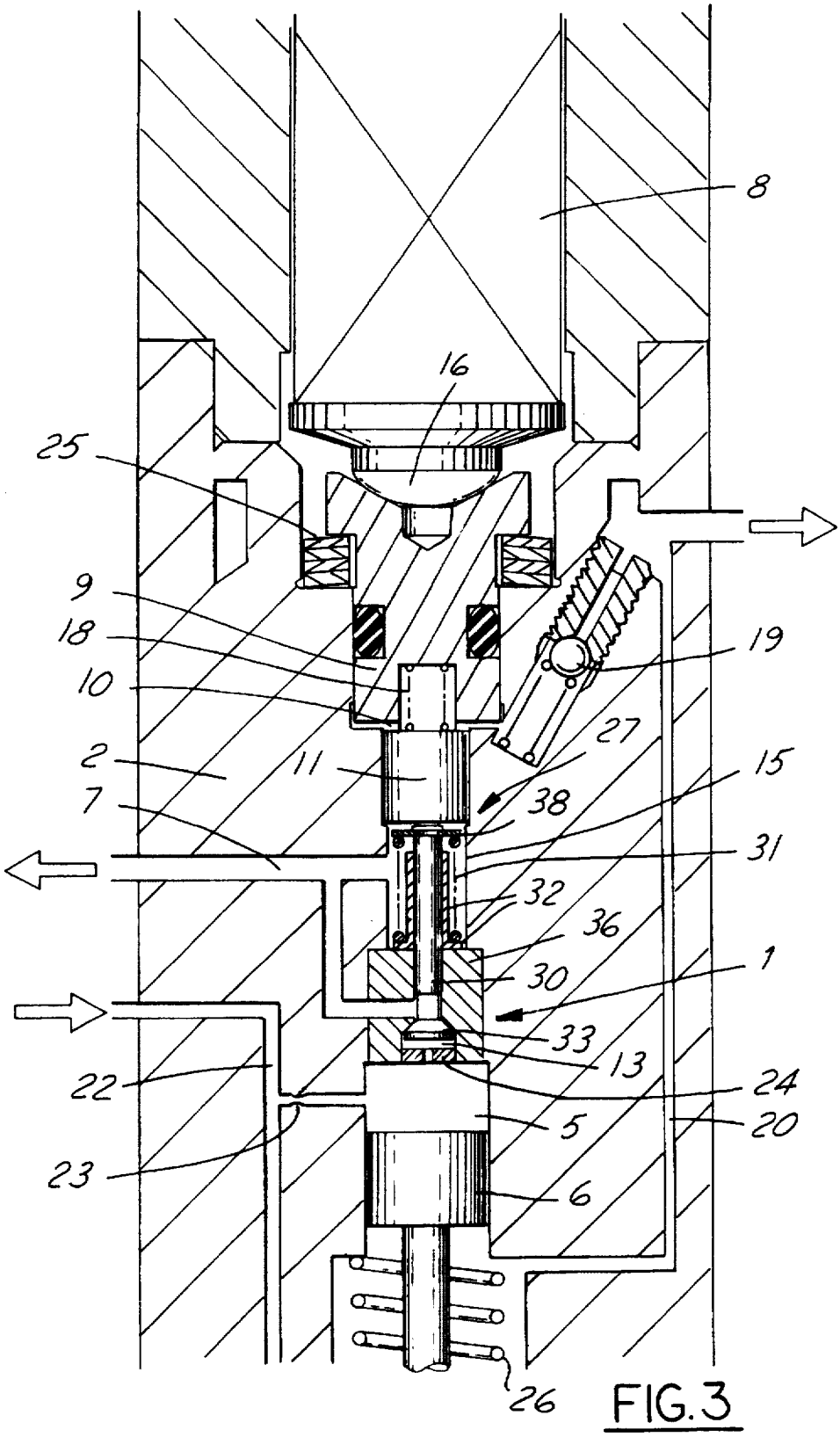

Note that the poppet valve sealing seat is shown in conical form in the FIG. 3 but can be just as effective if of different shape.

Figure 4C:
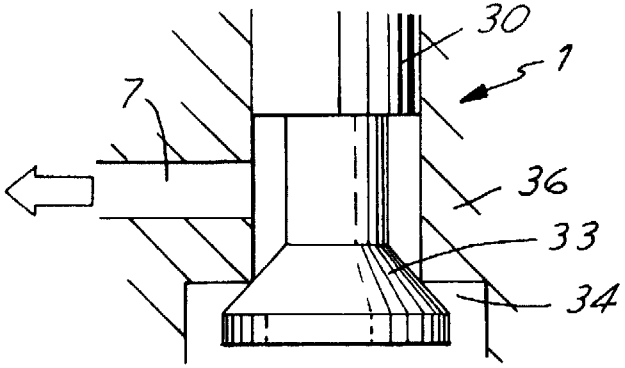
FIG. 4 illustrates various solutions of the poppet valve sealing seat.
Figure 4D:
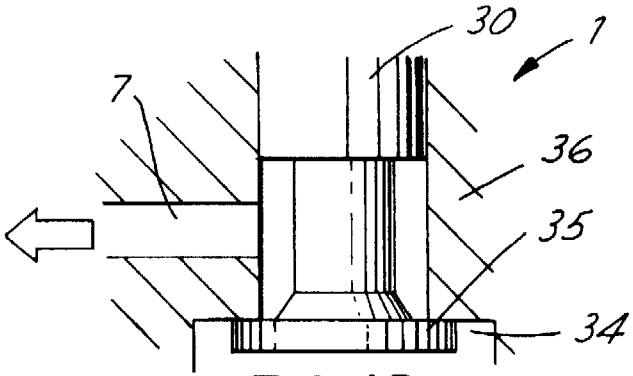
Figure 4A:
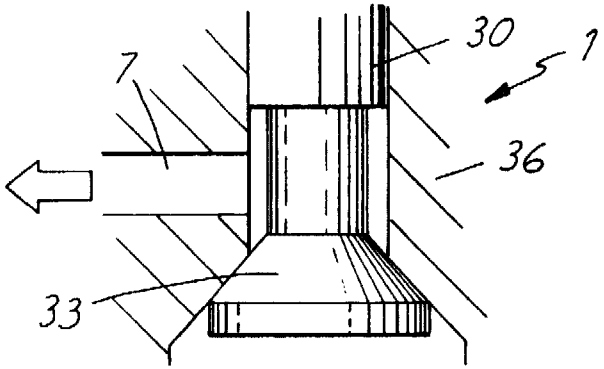

FIG. 4*a* shows a poppet valve 1 with a sealing seat, which is of conical shape 33 and cooperates with a valve body seat also of conical shape.

Figure 4B:
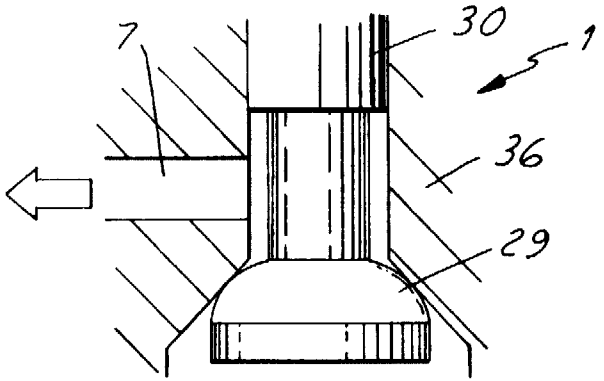

FIG. 4*b* shows a poppet needle sealing seat, which is of curvilinear shape 29 and cooperates with a valve body seat of conical shape.

FIG. 4*c* shows a poppet needle sealing seat, which is of conical shape 33 and cooperates with a valve body seat of planar shape 34.

FIG. 4*d* shows a poppet needle sealing seat, which is of planar shape 35 and cooperates with a valve body seat also of planar shape 34.

What is claimed is:

1. A fuel injector for internal combustion engines comprising:

a control valve housed in a body of the injector;

an electrical actuator device for operating said control valve;

an injector valve, housed in an end of said body, fitted with a nozzle needle that opens under the pressure of fuel fed by a feeding line, said needle retracting from its seat when the counter pressure contained in a control chamber, and acting on a power piston that is mechanically connected to the coaxial nozzle needle, is reduced in consequence of the control valve actuation hydraulically connected drain duct to said control chamber, wherein:

said electrical actuator device operates a first fluid-tight piston that faces onto a first chamber which is filled with fuel at a low pressure; and a second fluid-tight piston also faces the aforementioned first chamber, said second piston having an effective surface area smaller than that of said first piston;

said second piston operates a sealing component of said control valve, which is housed on the inside of a second chamber hydraulically connected to said control chamber, across a drain hole of said control valve;

wherein the pressure of the fuel contained in said first chamber causes the constant contact of said second piston with said sealing component of said control valve.

2. A fuel injector according to claim 1, wherein said sealing component is a ball and said second piston operates said ball by means of its end opposite from said first chamber through said drain hole of the control valve.

3. A fuel injector according to claim 1, wherein an adapter plate of spherical surface, cooperating with a conical seat formed on said first piston, is inserted between said actuator device and said first piston.

4. A fuel injector according to claim 1, wherein the contact between said first piston and said actuator device is by a elastic means acting on said first piston.

5. A fuel injector according to claim 4, wherein said elastic means acting on said first piston comprises one or more cup-shaped springs.

6. A fuel injector according to claim 1, additionally including a return spring housed in said second chamber, said return spring acting on said sealing component of said control valve in the direction of closing said control valve.

7. A fuel injector according claim 1, additionally including a return spring housed in said fuel feeding line up-stream of said second chamber said return spring acting on said sealing component of said control valve in the direction of closing said drain hole.

8. A fuel injector according to claim 1, additionally including a spring inserted between said first and second piston.

9. A fuel injector according to claim 1, additionally including a small refill valve facing onto said first chamber and connected to a recovery line of fuel leaked through peripheral clearance of said first and second pistons with said body.

10. A fuel injector according to claim 1, additionally including a small refill duct connected to a recovery line of the fuel leaked through peripheral clearance of said first and second pistons with said body, said refill duct flowing into a diametrical clearance that exists between one of said two pistons and said body of the injector.

11. A fuel injector according claim 1, additionally including a flow restrictor inserted into the section of the duct which hydraulically connects said control chamber to said fuel feeding line of the injection valve.

12. A fuel injector according to claim 1, further comprising a flow restrictor formed on the section of the hydraulic drain line between said control chamber and said drain duct.

13. A fuel injector according to claim 1, wherein said second piston operates a control valve poppet needle having a head cooperating with a valve body sealing seat, the pressure of the fuel contained in said first chamber causes the constant contact of said second piston with said control valve poppet needle, and a second return spring housed inside a spring chamber located between said second piston and the valve body, said second return spring being mechanically connected to said poppet needle and acting on said needle in the direction of closing said control valve.

14. A fuel injector according to claim 13, wherein said control valve poppet needle head is of conical shape and cooperates with said valve body sealing seat also of conical shape.

15. A fuel injector according to claim 13, wherein said control valve poppet needle head is of curvilinear shape and cooperates with said valve body sealing seat of conical shape.

16. A fuel injector according to claim 13, wherein said control valve poppet needle head is of conical shape and cooperates with said valve body sealing seat of planar shape.

17. A fuel injector according to claim 13, wherein said control valve poppet needle head is of planar shape and cooperates with said valve body sealing seat also of planar shape.

18. A fuel injector according to claim 1, additionally including a stroke limit stop means for said second piston.

19. A fuel injector according to claim 13, additionally including a stroke limit stop means for said control valve poppet needle.

* * * * *